US008776809B2

(12) United States Patent
Ma et al.

(10) Patent No.: US 8,776,809 B2
(45) Date of Patent: Jul. 15, 2014

(54) SHORT FORCE ARM DEFLECTION DEVICE

(76) Inventors: Joen-Shen Ma, Taipei (TW); Yung Cheng Ma, Taipei (TW)

( * ) Notice: Subject to any disclaimer, the term of this patent is extended or adjusted under 35 U.S.C. 154(b) by 250 days.

(21) Appl. No.: 13/370,436

(22) Filed: Feb. 10, 2012

(65) Prior Publication Data

US 2013/0206192 A1 Aug. 15, 2013

(51) Int. Cl.
*A45B 17/00* (2006.01)

(52) U.S. Cl.
USPC ..... 135/20.1; 135/20.3

(58) Field of Classification Search
USPC ..... 135/15.1, 20.1, 20.3
See application file for complete search history.

(56) References Cited

U.S. PATENT DOCUMENTS

| | | | | |
|---|---|---|---|---|
| 2,721,569 | A * | 10/1955 | Militano | 135/20.3 |
| 3,489,157 | A * | 1/1970 | Morton | 135/20.3 |
| 3,521,651 | A * | 7/1970 | Morton | 135/20.1 |
| 4,582,078 | A * | 4/1986 | Ma | 135/20.3 |
| 6,446,650 | B1 * | 9/2002 | Ma | 135/20.3 |
| 6,516,820 | B1 * | 2/2003 | Earnshaw | 135/20.1 |
| 6,575,182 | B2 * | 6/2003 | Tung | 135/20.1 |
| 8,272,391 | B2 * | 9/2012 | Luo | 135/20.1 |
| 8,534,304 | B1 * | 9/2013 | Tung | 135/20.1 |
| 2011/0126870 | A1 * | 6/2011 | Luo | 135/20.3 |

* cited by examiner

*Primary Examiner* — David R Dunn
*Assistant Examiner* — Danielle Jackson
(74) *Attorney, Agent, or Firm* — Rosenberg, Klein & Lee

(57) ABSTRACT

A short force arm deflection device is mounted to a section of a center post of an umbrella between a top cap and a runner and includes an upper deflection member and a lower deflection member pivotally connected to each other, and a barrel receiving a compression spring. The upper and lower deflection members are respectively connected to a lower end of an upper post segment and an upper end of a lower post segment. The barrel, receives the compression spring and goes over the connection portion between the lower deflection member and the lower post segment. To open, the runner is pulled upwardly by a pull cord to contact the barrel causing a relative rotation between the upper and lower deflection members for realizing deflection between the top cap and the runner for inclining a canopy.

5 Claims, 6 Drawing Sheets

SHORT FORCE ARM DEFLECTION DEVICE

BACKGROUND OF THE INVENTION

1. Field of the Invention

The present invention relates to a short force arm deflection device, and in particular to a deflection device that is mountable to a section of center post of an umbrella between a top cap and a runner to provide a short force arm that allows deflection and canopy opening operated in an effortless manner and belongs to a technical field of improved deflection device of umbrella.

2. The Related Arts

For commonly used large-sized umbrellas, such as beach parasols, garden parasols, and advertisement umbrella, to make opening the umbrellas easy, a winding device that is mounted to an umbrella center post is employed, in which the winding device comprises a crank arm, which when rotated, drives a pull cord concealed in the interior of the center post to pull a runner to move along the center post. The umbrella is opened when the runner is moved upward and the umbrella is closed when the runner moves downward. Some umbrellas are provided with a deflection device, whereby if the pull cord is controlled to continuously pull the runner to move upward after the umbrella has been completely opened, the deflection device that is mounted to the center post is actuated to incline the umbrella by an angle.

The conventional deflection device, once mounted to an umbrella, exhibits such a significant feature that when the runner is pulled upward to open the umbrella, the deflection device is located on the center post at a position below the runner. If the runner is further pulled to move upward, the deflection device will incline the umbrella canopy by an angle, where the deflection device that is located below the runner get further from the runner.

Heretofore, the deflection device is mounted to an umbrella center post at a position below the runner and consequently, for the center post, a long force arm is formed above a deflection portion of the deflection device for supporting the total weight of the whole umbrella top, including a top cap, ribs, stretchers, and the runner. The deflection device will bear a greater gravitational force when the deflection device makes a deflection angle that is larger and thus the inclination of the umbrella canopy is greater. Such a great force is only supported by a pivot pin of the deflection device and this may easily cause damage to the components thereof. Malfunctioning of the deflection device makes the operation of smooth umbrella opening and deflection impossible. The long force arm makes opening umbrella laborious. However, make the deflection device of a material of good strength may, sometimes, causes an excessively increased expenditure. All these problems are commonly seen in the umbrellas to which the conventional deflection devices are mounted.

SUMMARY OF THE INVENTION

An objective of the present invention is to overcome the drawbacks of the conventional umbrella deflection devices that have a long force arm by providing a short force arm deflection device.

In other words, the short force arm deflection device according to the present invention is mountable to various large-sized umbrellas, and especially mounted to a section of center post of the umbrella between a top cap and a runner to make the operation of deflection effortless. The short force arm arrangement allows the deflection device to bear the minimum load and thereby significantly extending the lifespan of the umbrella.

To achieve the above objective, the present invention adopts the following technical solution:

The present invention provides a short force arm deflection device, which is mounted to a section of a center post of an umbrella between a top cap and a runner, and comprising an upper deflection member, a lower deflection member, and a barrel that receives therein a compression spring.

The upper deflection member is connected to a lower end of an upper post segment of the center post.

The lower deflection member is connected to an upper end of a lower post segment of the center post.

The upper deflection member and the lower deflection member are jointed by a first pivot pin so that deflection can be effected between the upper and lower deflection members through relative rotation about the first pivot pin for setting an umbrella canopy at an inclination angle.

The barrel that receives therein the compression spring is fit over the connection between the lower deflection member and the lower post segment of the center post.

A connection plate is arranged between the barrel and the lower deflection member to transmit the power of the runner moving upward to control the upper and lower deflection members to carry out the deflection therebetween.

In opening the umbrella, the runner is pulled upward along the lower post segment by a pull cord to get into contact with the barrel and the compression spring received in the barrel drives the connection plate in a direction from the lower side to the upper side, thereby transmitting the power to cause the deflection between the upper and lower deflection members to carry out between the top cap and the runner.

The deflection device of the present invention, when mounted to an umbrella, shows the feature that the deflection device is mounted to a section of the center post between the top cap and the runner of the umbrella. The portion of the center post, which is above the deflection point of the deflection device, forms the shortest force arm that supports the umbrella canopy.

In both opening the umbrella or taking a deflection for changing direction, the runner is always kept on an upright portion of the center post. A significant portion of the gravity of umbrella, after being open, is born by the runner. In making the deflection, whether the inclination angle of the umbrella canopy is large or small, the deflection device only takes a very limited portion of the gravity. This makes the deflection device not easy to get malfunctioning and thus increases this life span of the umbrella, especially the deflection device.

According to the present invention, the deflection of an umbrella can be done in an easy and effortless manner, because the deflection device of the present invention is operable by using the upward push caused by an upward moving runner to force a barrel and a connection plate upward to realize deflection between a lower deflection member and an upper deflection member, rather than using the tension of a pull cord of conventional deflection device to cause deflection between the lower deflection member and the upper deflection member, whereby the operation of deflection of an umbrella can be effected in an effortless manner.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
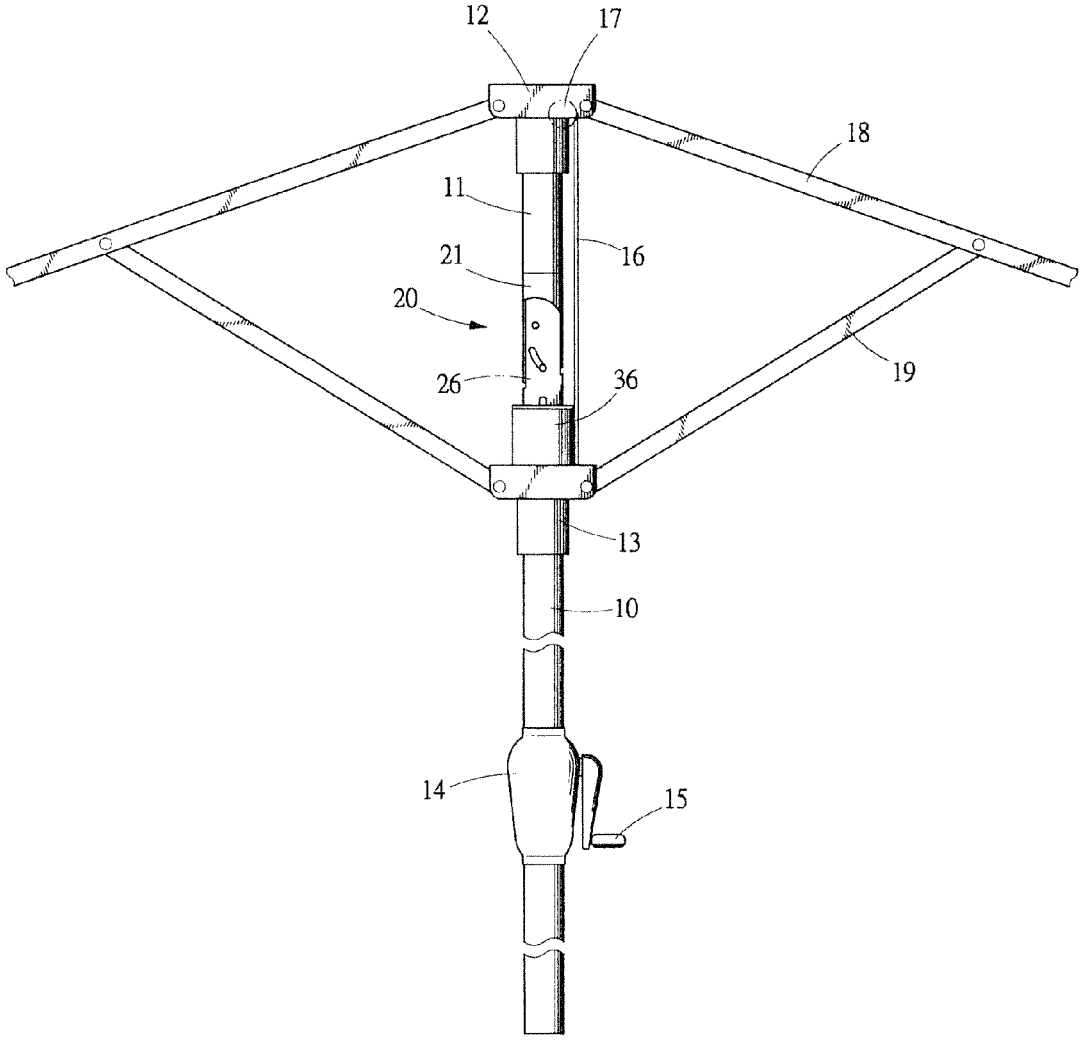
FIG. 1 is a schematic view showing a deflection device according to the present invention mounted to an umbrella, the umbrella being shown in an erected upright condition.

FIG. 1 is a schematic view showing a deflection device according to the present invention, generally designated at 20, mounted to an umbrella. In the drawing, the umbrella is shown in an erected upright condition.

Figure 2:
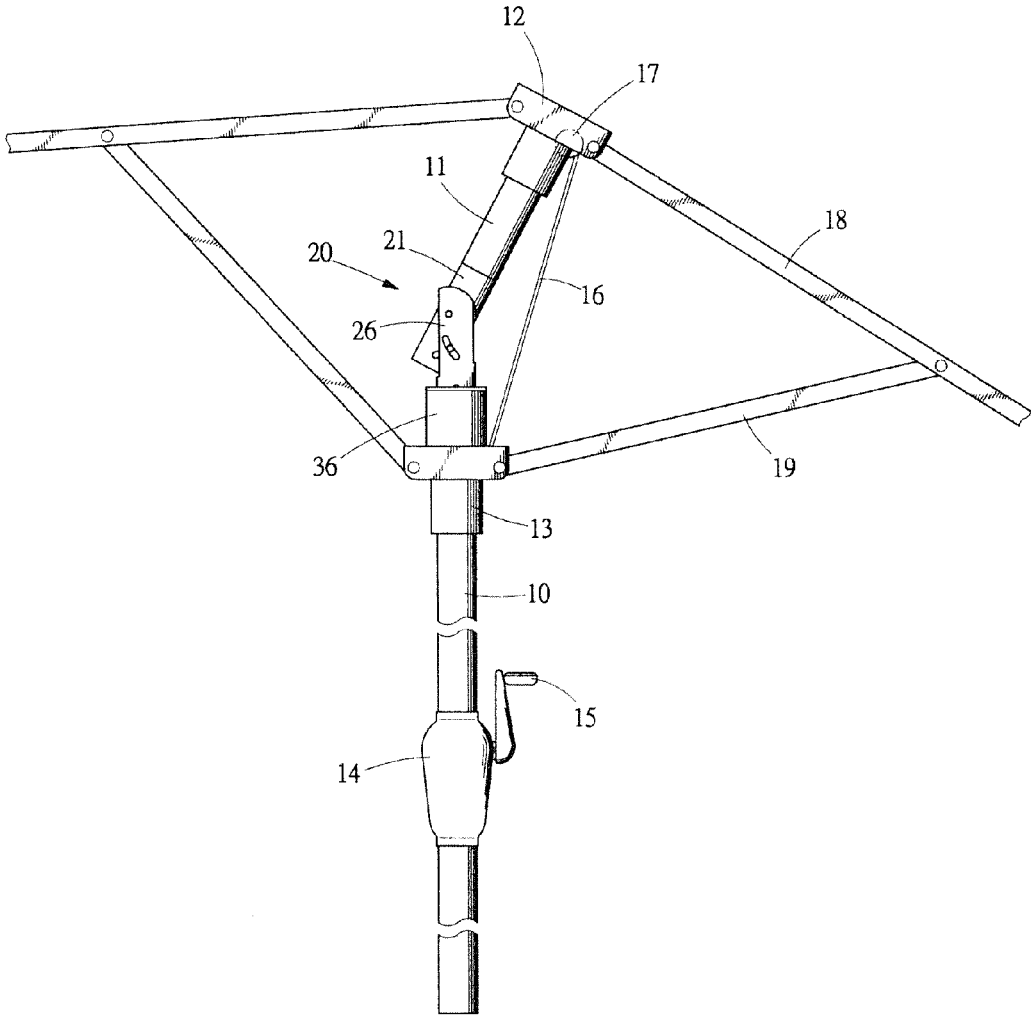
FIG. 2 is a schematic view showing a step of an inclination operation subsequent to FIG. 1 and illustrating that through rotation of a crank arm, the umbrella is converted into a deflected condition.

FIG. 2 is a schematic view showing a step of an inclination operation subsequent to FIG. 1. The drawing shows that through rotation of a crank arm 15, the umbrella is converted into a deflected condition.

As shown in FIGS. 1 and 2, the present invention provides a short force arm deflection device 20, which is mounted to a section of a center post between a top cap 12 and a runner 13 of the umbrella. The deflection device 20 comprises an upper deflection member 21, a lower deflection member 26, and a barrel 36 that receives therein a compression spring.

As shown in FIGS. 1 and 2, the umbrella comprises a lower post segment 10, an upper post segment 11, a top cap 12, a runner 13, a winding device 14, a crank arm 15, a pull cord 16, a guide roller 17, ribs 18, and stretchers 19.

The top cap 12 is fixed to a top end of the upper post segment 11. The runner 13 is fit over the lower post segment 10 and is vertically movable. Each of the ribs 18 has an upper end pivoted to the top cap 12. Each of the stretchers 19 has an upper end pivoted to a middle portion of the respective rib 18 and a lower end pivoted to the runner 13. The deflection device 20 according to the present invention is coupled between the upper post segment 11 and the lower post segment 10.

The winding device 14 is fixed to the lower post segment 10. The pull cord 16 has an end wound inside the winding device 14 and an opposite end extending through a hollow interior of the lower post segment 10, the deflection device 20, a hollow interior of the upper post segment 11, and the guide roller 17 of the top cap 12 to connect to the runner 13.

Rotating the crank arm 15 drives the pull cord 16 to pull the runner 13 to move upward and the umbrella is opened, as shown in FIG. 1. After the umbrella has been opened, if the crank arm 15 is further rotated, the pull cord 16 would further pull the runner 13 to move upward and make a contact with the barrel 36. The barrel 36 then controls the deflection device 20 to carry out a deflection operation to thereby incline the umbrella canopy at an inclination angle, as shown in FIG. 2.

Figure 3:
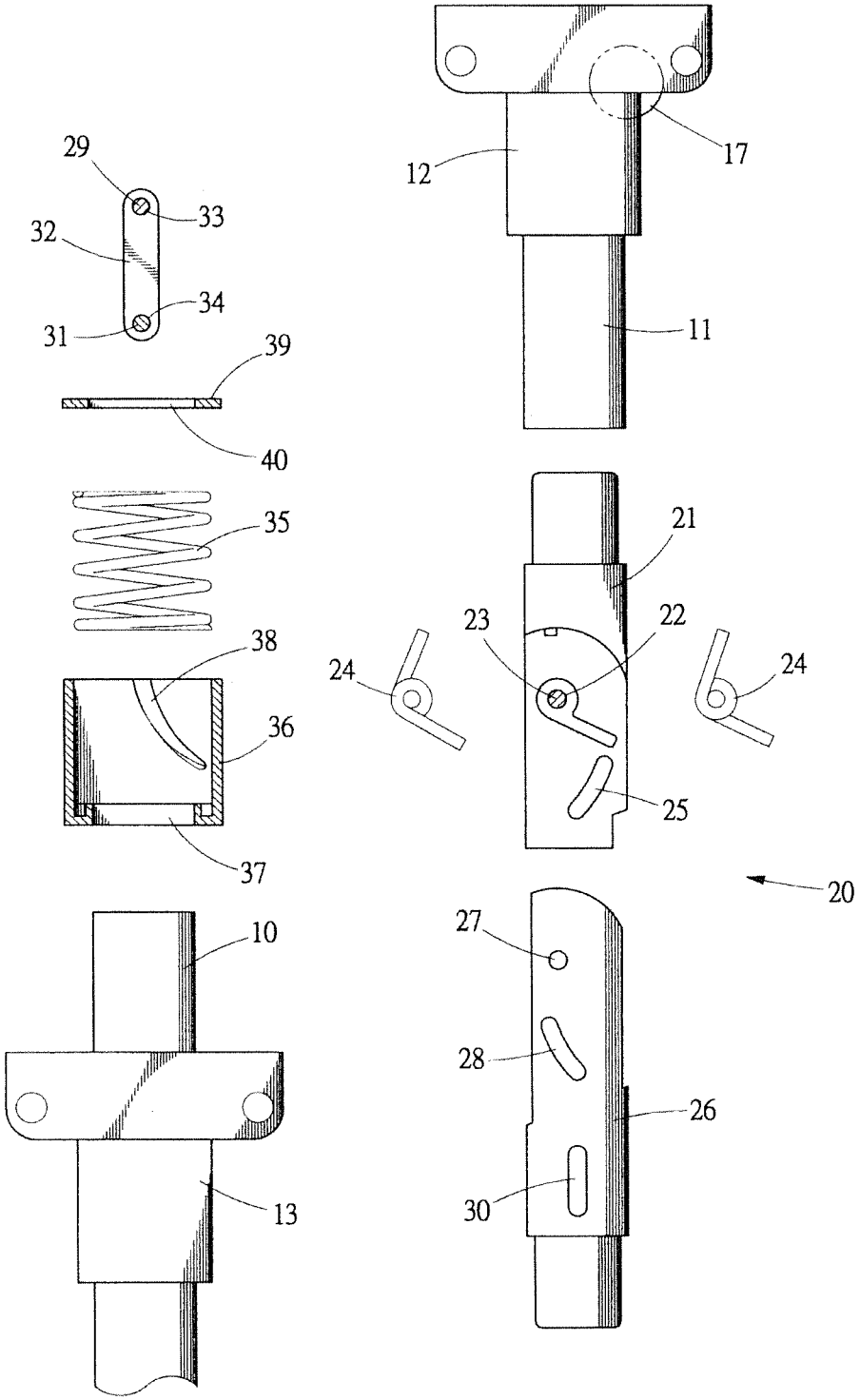
FIG. 3 is an exploded view of the deflection device according to the present invention.

FIG. 3 is an exploded view of the deflection device 20 according to the present invention.

Figure 4:
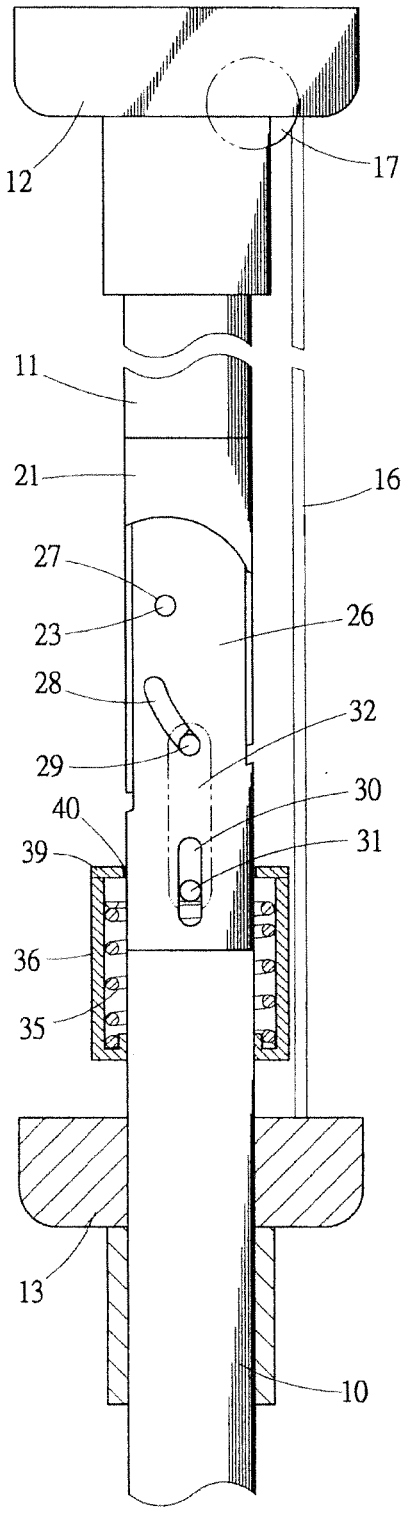
FIG. 4 is a cross-sectional view of the deflection device according to the present invention in the upright condition.

FIG. 4 is a cross-sectional view of the deflection device 20 according to the present invention in an upright condition.

Figure 5:
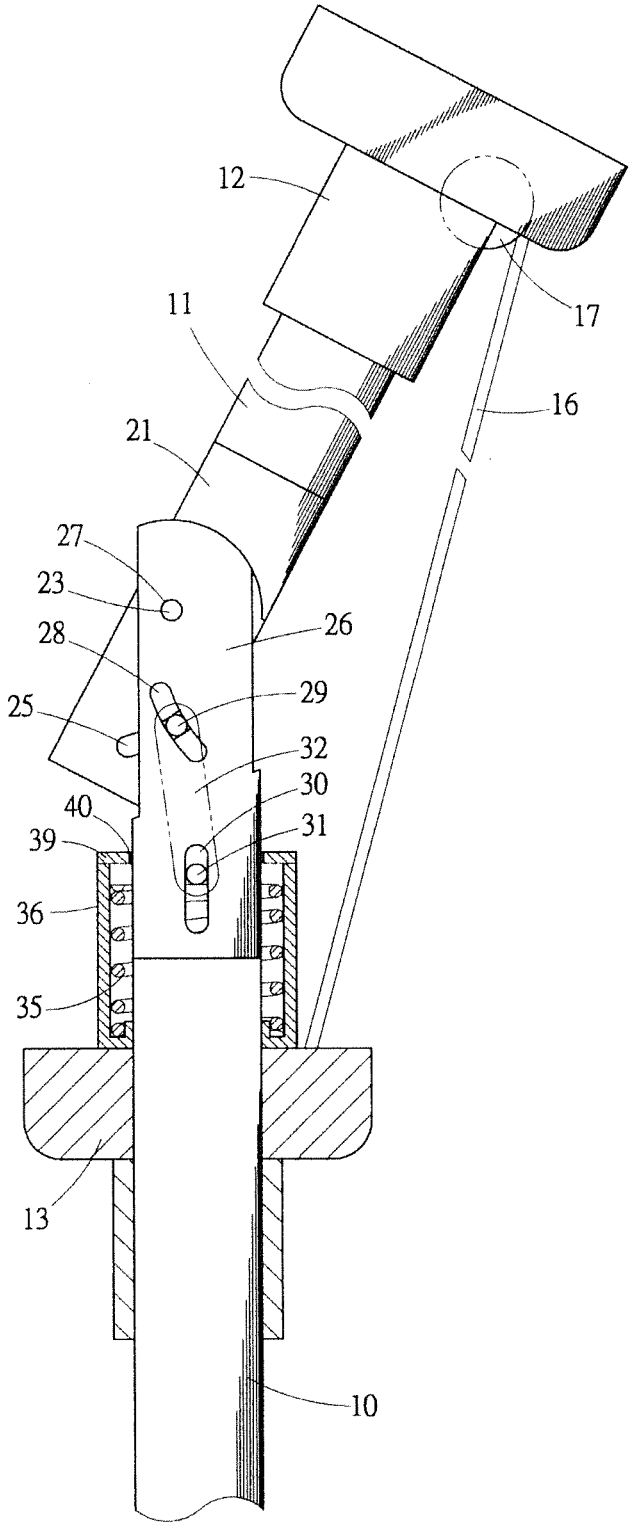
FIG. 5 is a cross-sectional view of the deflection device according to the present invention in an inclined condition.

FIG. 5 is a cross-sectional view of the deflection device 20 according to the present invention in an inclined condition.

Figure 6:
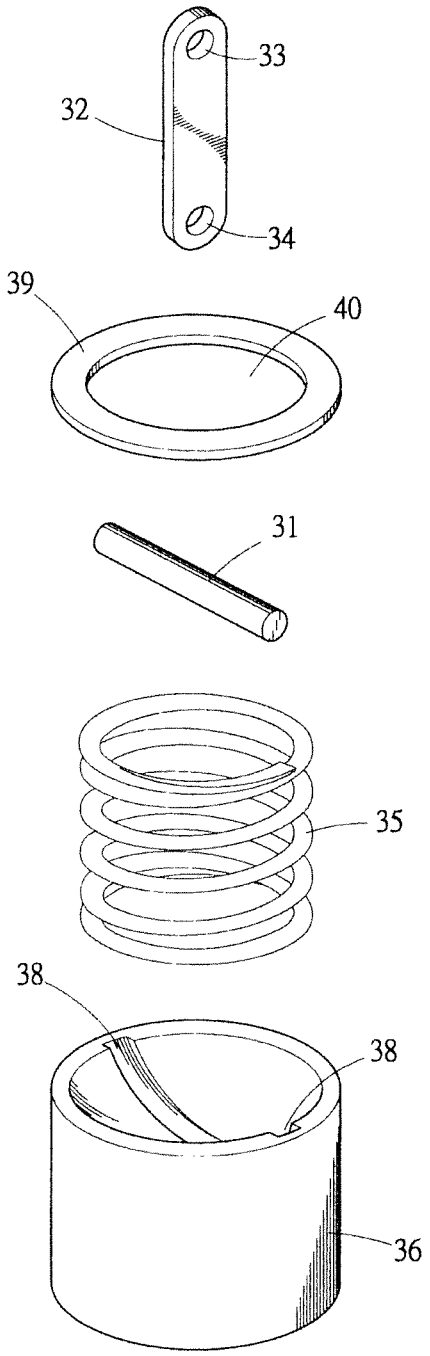
FIG. 6 is an exploded view showing a barrel according to the present invention.

FIG. 6 is an exploded view showing the barrel 36 according to the present invention.

As shown in FIGS. 3 and 4, the deflection device 20 of the present invention comprises the upper deflection member 21 that is connected to a lower end of the upper post segment 11. The upper deflection member 21 forms pivot holes 22 and a first pivot pin 23 is received through the pivot holes 22 to pivotally couple the lower deflection member 26. Arc slots 25 are formed in the upper deflection member below the pivot holes 22. Torsion springs 24 are respectively arranged at opposite sides of the pivot holes 22 and the two torsion springs 24 also receive the first pivot pin 23 to extend therethrough. Each of the torsion springs 24 has an end fixed to the upper deflection member 21 and an opposite end fixed to the lower deflection member 26, whereby the two torsion springs 24 provide a biasing force for returning the deflection device back to the upright condition.

As shown in FIGS. 3 and 4, the lower deflection member 26 is mounted to an upper end of the lower post segment 10. The lower deflection member 26 forms pivot holes 27, through which the first pivot pin 23 is received, whereby deflection about an axis defined by the first pivot pin 23 can be realized between the upper deflection member 21 and the lower deflection member 26, as shown in FIG. 5. The lower deflection member forms an arc slot 28 below each of the pivot hole 27 and the arc slots 28 correspond to the arc slots 25 of the upper deflection member 21. The arc slots 25, 28 receive a second pivot pin 29 therethrough. The lower deflection member forms a longitudinal slot 30 below each of the arc slots 28 and the longitudinal slots 30 receive a third pivot pin 31 therethrough.

As shown in FIG. 4, the barrel 36 is fit over connection between the lower deflection member 26 and the lower post segment 10.

As shown in FIGS. 3, 4, and 6, the barrel 36 has a bottom through which a bore 37 is formed, as shown in FIG. 3, to receive the lower post segment 10 to extend therethrough. A compression spring 35 is received in a hollow interior of the barrel 36, as shown in FIG. 4. Curved grooves 38 are formed in symmetrical sites on inside surface of the barrel 36, as shown in FIG. 6. The two curved grooves 38 respectively and movably receive opposite ends of the third pivot pin 31. A top cover 39 is mounted to and closes an open end of the barrel 36. The top cover 39 forms a bore 40. A connection plate 32 forms an upper pin hole 33 and a lower pin hole 34. The upper pin hole 33 receives the second pivot pin 29 therethrough and the second pivot pin 29 is also received through the arc slots 25 of the upper deflection member 21 and the arc slots 28 of the lower deflection member 26, as shown in FIGS. 4 and 5. The lower pin hole 34 of the connection plate 32 receives the third pivot pin 31 therethrough and the third pivot pin 31 is also received through the longitudinal slots 30 of the lower deflection member 26. Further, the third pivot pin 31 is located between the compression spring 35 received in the barrel 36 and the top cover 39. The two ends of the third pivot pin 31 are respectively and movably received in the curved grooves 38 defined in opposite sides of the inside surface of the barrel 36.

The operation of the invention is that in attempting to open the umbrella, the crank arm 15 of the winding device 14 is rotated to have the pull cord 16 drive the runner 13 to move upward thereby opening the umbrella, as shown in FIGS. 1 and 4.

After the umbrella has been opened, further rotating the crank arm 15 would cause the pull cord 16 to further pull the runner 13 to move upward so that the runner 13 may eventually brought into contact with the barrel 36, as shown in FIGS. 2 and 5. The barrel 36 is then forced upward by the runner 13 and the compression spring 35 moves the third pivot pin 31, which in turn drives, via the connection plate 32, the second pivot pin 29 to take a generally upward movement by following the arc slots 25 of the upper deflection member 21 and the arc slots 28 of the lower deflection member 26. Thus, a very limited upward pushing force is sufficient for causing relative rotation between the upper deflection member 21 and the lower deflection member 26 about the first pivot pin 23 thereby deflecting an umbrella canopy to an inclination angle, as shown in FIGS. 2 and 5.

To close the umbrella, the umbrella closing operation is similar to those of the conventional large-sized umbrellas. A release button included in the winding device 14 is actuated to release the tensioned pull cord 16, and the biasing forces of the two torsion springs 24 between the upper deflection member 21 and the lower deflection member 26 causes a returning operation, which together with downward movements of the second pivot pin 29 and the third pivot pin 31 caused by the connection plate 32, allows the compression spring 35 and the barrel 36 to drive the runner 13 downward for position returning thereby making the umbrella canopy straight upright again for closing the umbrella.

The deflection device 20, once mounted to an umbrella, shows such a feature that the device is mountable to a section of the center post that is located between the top cap 12 and the runner 13 of the umbrella, whereby the portion of the center post that is located above the deflection point of the deflection device 20 forms a shortest force arm to support the umbrella canopy.

The above discussed advantage of the present invention is quite apparent for the short force arm deflection device 20, in both opening the umbrella or taking a deflection for changing direction, the runner 13 is always kept on an upright portion of the center post. A significant portion of the gravity of umbrella, after being open, is born by the runner 13. In making the deflection, whether the inclination angle of the umbrella canopy is large or small, the deflection device 20 only takes a very limited portion of the gravity. This makes the deflection device not easy to get malfunctioning and thus increases this life span of the deflection device 20.

According to the present invention, the deflection of an umbrella can be done in an easy and effortless manner, because the deflection device 20 of the present invention is operable by using the upward push caused by an upward moving runner 13 to force a barrel 36 and a connection plate 32 upward to realize deflection between a lower deflection member 26 and an upper deflection member 21, rather than using the tension of a pull cord of conventional deflection device to cause deflection between the lower deflection member and the upper deflection member, whereby the drawbacks of the conventional deflection devices can be effectively overcome.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A short force arm deflection device, adapted to be mounted to a section of a center post of an umbrella between a top cap and a runner, and comprising:

an upper deflection member, which is connected to a lower end of an upper post segment of the center post, the upper deflection member forming a pivot hole, a first pivot pin being received through the pivot hole to pivotally couple the upper deflection member to a lower deflection member;

the lower deflection member, which is connected to an upper end of a lower post segment of the center post, the lower deflection member forming a pivot hole, through which the first pivot pin is received to allow of relative rotation between the upper deflection member and the lower deflection member about the first pivot pin thereby realizing deflection of the umbrella; and a barrel, which receives therein a compression spring and is fit over a connection between the lower deflection member and the lower post segment;

wherein in opening the umbrella, the runner is pulled upward along the lower post segment by a pull cord and comes in contact with the barrel so as to cause the relative rotation between the upper deflection member and the lower deflection member for realizing the deflection between the top cap and the runner to make an umbrella canopy incline at an inclination angle.

2. The short force arm deflection device as claimed in claim 1, wherein the umbrella comprises the lower post segment, the upper post segment, the top cap, the runner, a winding device, a crank arm, the pull cord, a guide roller, ribs, and stretchers, the top cap being mounted to an upper end of the upper post segment, the runner being fit over the lower post segment and vertically movable, each of the ribs having an upper end pivoted to the top cap, each of the stretchers having an upper end pivoted to a middle portion of the respective rib and a lower end pivoted to the runner, the deflection device being coupled between the upper post segment and the lower post segment, the winding device being fixed to the lower post segment, the pull cord having an end that is wound up and received inside the winding device and an opposite end extending through a hollow interior of the lower post segment, the deflection device, a hollow interior of the upper post segment, and the guide roller of the top cap to connect to the runner, whereby rotating the crank arm causes the pull cord to pull the runner upward to open the umbrella and further rotating the crank arm after the umbrella is open causes the pull cord to further pull the runner upward to contact the barrel, thereby making the barrel actuating the deflection device to carry out the defection and thus setting the umbrella canopy at the inclination angle.

3. The short force arm deflection device as claimed in claim 1, wherein an arc slot is formed in the upper deflection member below the pivot hole, torsion springs being arranged at opposite sides of the pivot hole and both receiving the first pivot pin to extend therethrough, each of the torsion springs having an end fixed to the upper deflection member and a lower end fixed to the lower deflection member, whereby the torsion springs provides a biasing force for returning the deflection device back to an upright condition.

4. The short force arm deflection device as claimed in claim 1, wherein the lower deflection member forms an arc slot below the pivot hole, the arc slot corresponding to an arc slot in the upper deflection member, the two are slots receiving a second pivot pin therethrough, the lower deflection member forming a longitudinal slot below the arc slot, the longitudinal slot receiving a third pivot pin therethrough.

5. The short force arm deflection device as claimed in claim 1, wherein the barrel has a bottom through which a bore is formed to receive the lower post segment therein a compression spring being received in a hollow interior of the barrel, curved grooves being formed in symmetrical sites on an inside surface of the barrel, the curved grooves respectively and movably receive opposite ends of a third pivot pin, a top cover being mounted to and closing an open end of the barrel, the top cover forming a bore, a connection plate forming an upper pin hole and a lower pin hole, the upper pin hole receiving a second pivot pin therethrough and the second pivot pin being also received through an arc slot in the upper deflection member and an arc slot in the lower deflection member, the lower pin hole of the connection plate receiving the third pivot pin therethrough and the third pivot pin being also received through a longitudinal slot in the lower deflection member, the third pivot pin being located between the compression spring received in the barrel and the top cover, the ends of the third pivot pin being respectively and movably received in the curved grooves defined in opposite sides of the inside surface of the barrel.

* * * * *